US007032429B1

(12) United States Patent
McDougle

(10) Patent No.: US 7,032,429 B1
(45) Date of Patent: Apr. 25, 2006

(54) PIPE SHUT OFF TOOL

(76) Inventor: Lawrence S. McDougle, 5004 Frazee Rd., Oceanside, CA (US) 92057

( * ) Notice: Subject to any disclaimer, the term of this patent is extended or adjusted under 35 U.S.C. 154(b) by 0 days.

(21) Appl. No.: 11/015,203

(22) Filed: Dec. 17, 2004

(51) Int. Cl.
*B21D 28/20* (2006.01)
*B21D 15/03* (2006.01)
*B21J 13/02* (2006.01)

(52) U.S. Cl. ..... 72/453.15; 72/326; 72/367; 72/453.03; 72/413

(58) Field of Classification Search ..... 72/326, 72/367, 413, 414, 453.03, 453.15, 453.16
See application file for complete search history.

(56) References Cited

U.S. PATENT DOCUMENTS 3,017,905 A * 1/1962 Klein ..... 72/453.16
3,937,050 A * 2/1976 Nicholson ..... 72/453.16
4,231,246 A * 11/1980 Gorenc et al. ..... 72/453.16
4,242,903 A * 1/1981 Ledford et al. ..... 72/453.01
4,790,168 A * 12/1988 Vonthien ..... 72/389.6
5,042,757 A * 8/1991 Jenkins et al. ..... 248/75
5,381,686 A * 1/1995 Thorup ..... 72/453.16
5,437,177 A * 8/1995 Orcutt et al. ..... 72/453.16
5,666,848 A * 9/1997 Burns ..... 72/453.16

* cited by examiner

*Primary Examiner*—David B. Jones
(74) *Attorney, Agent, or Firm*—Stetina Brunda Garred & Brucker

(57) ABSTRACT

A pipe shut off tool is provided which may comprise a jaw that may be engaged to a defective pipe and a pump operative to translate the jaw between a crimping position and a release position. The jaw and pump may be connected to each other via an elongate flexible hose such that the jaw may inserted into a compact space and engage the pipe located therein and the pump may be placed outside of the compact space near the operator such that the tool operator may translate the jaw to the crimping position from outside the compact space.

14 Claims, 5 Drawing Sheets

PIPE SHUT OFF TOOL

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates generally to a pipe shut off tool for cutting off fluid flow through a pipe, and more particularly, to a hydraulically operated pipe shut off tool.

Prior art pipe shut off tools generally have two plates which may be tightened or compressed onto a pipe to prevent fluid flow through the pipe. One method of tightening or compressing the plates onto the pipe is via a set of bolts. For example, two plates may be adjacently aligned to each other and bolted together with four bolts, one bolt located at each of four corners of the plates. The pipe may be placed between the plates with two bolts on each side of the pipe. Thereafter, the bolts may be tightened so as to draw the two plates together onto the pipe until the pipe has been crimped to prevent fluid flow through the pipe. However, tightening the bolts is a time consuming process because all four bolts must be tightened simultaneously and tightening the bolts may be a slow process, especially when tightened via a hand held wrench—manual wrench.

Further, the process of tightening the bolts may be cumbersome because the pipe to be shut off (i.e., the subject pipe) may be confined in a compact space such that the tool operator cannot reach the bolts with the wrench to tighten the bolts. For example, a building may have a system of pipes which supply water to the building's restrooms, sinks, and water fountains. Some of the pipes may be piped between walls, within compact spaces, and adjacent other structures (e.g., cement or metal pillars). If one of these pipes leaks or bursts, then surrounding drywall or other structures may have to be removed such that maintenance personnel can shut off the water flowing through the pipe. However, certain structures within the building may not be removable such as load bearing columns, metal or cement structures. Accordingly, such structures may interfere with maintenance personnel's ability to position the pipe shut off tool over the broken pipe and tighten the bolts.

Accordingly, there is a need in the art for an improved pipe shut off tool.

BRIEF SUMMARY OF THE INVENTION

The present invention alleviates the above-identified and other deficiencies in the prior art. The pipe shut off tool of the present invention may comprise a pump, a hose, a cylinder and a jaw which may be hydraulically and mechanically connected to each other. The pump may be hydraulically connected to the cylinder via the hose. Also, the cylinder may be mechanically connected to the jaw. The hose may be an elongate flexible hose such that the jaw may be placed around the pipe which may be located in a compact space, and the pump may be placed near the tool operator (e.g., maintenance personnel) away from the compact space. This allows the operator to conveniently operate the jaw from outside the compact space.

The pump may be a hand pump having a handle. The handle may be strokable between first and second positions. The handle is in the first position when the handle is parallel with a body of the pump and in the second position when the handle is oblique with the pump body. Each stroke (i.e., first position to second position and back to the first position) of the hand pump handle may displace hydraulic fluid from the pump body through the hose and toward the cylinder. The cylinder may be attached to the jaw such that first and second crimping surfaces of the jaw may be drawn toward each other during each handle stroke. If a pipe is placed between the first and second crimping surfaces, then the crimping surfaces may crimp the pipe to prevent fluid flow through the pipe by repeatedly stroking the handle. This combination of pump, elongate flexible hose, cylinder and jaw provides a convenient method of crimping the pipe by locating the mechanism (i.e., pump) which actuates the jaw away from the jaw itself via the flexible elongate hose. For example, the jaw may be placed within the compact space and actuated by the pump outside of the compact space. Hence, operation of the pipe shut off tool is convenient.

The pipe shut off tool is also advantageous for use in shutting off fluid flow through an underground pipe. For example, dirt surrounding a leaking underground pipe may be removed to expose the leaking underground pipe such that maintenance personnel may fix the leaking underground pipe. However, since the leaking underground pipe is below ground level, the maintenance personnel may place the jaw around the leaking underground pipe and place the pump at ground level to conveniently operate the jaw around the underground pipe until fluid flow through underground pipe is shut off.

The pump may also be a two speed pump. The pump may operate at a first speed prior to the first and second crimping surfaces applying crimping pressure onto the pipe. After a threshold crimping pressure is applied to the pipe or hydraulic fluid of the pump reaches a threshold pressure, then the pump may operate at a second speed. The first speed pumps hydraulic fluid from the pump at a greater rate than the second speed and draws the crimping surfaces together at a faster rate than the second speed. In other words, the crimping surfaces may be rapidly closed onto the pipe until the crimping surfaces contact the pipe and the hydraulic fluid threshold pressure is reached. Thereafter, the pump may transition to the second speed. During the second speed, the jaw closes onto the pipe at a slower rate than during the first speed but is capable of applying greater pressure or force onto the pipe compared to the pressure or force applyable to the pipe during the first speed. This arrangement provides for rapid travel of the crimping surfaces onto the pipe and higher application pressure once the crimping surfaces contact the pipe.

BRIEF DESCRIPTION OF THE DRAWINGS

An illustrated and presently preferred embodiment of the present invention is shown in the accompanying drawings in which.

DETAILED DESCRIPTION OF THE INVENTION

Figure 1:
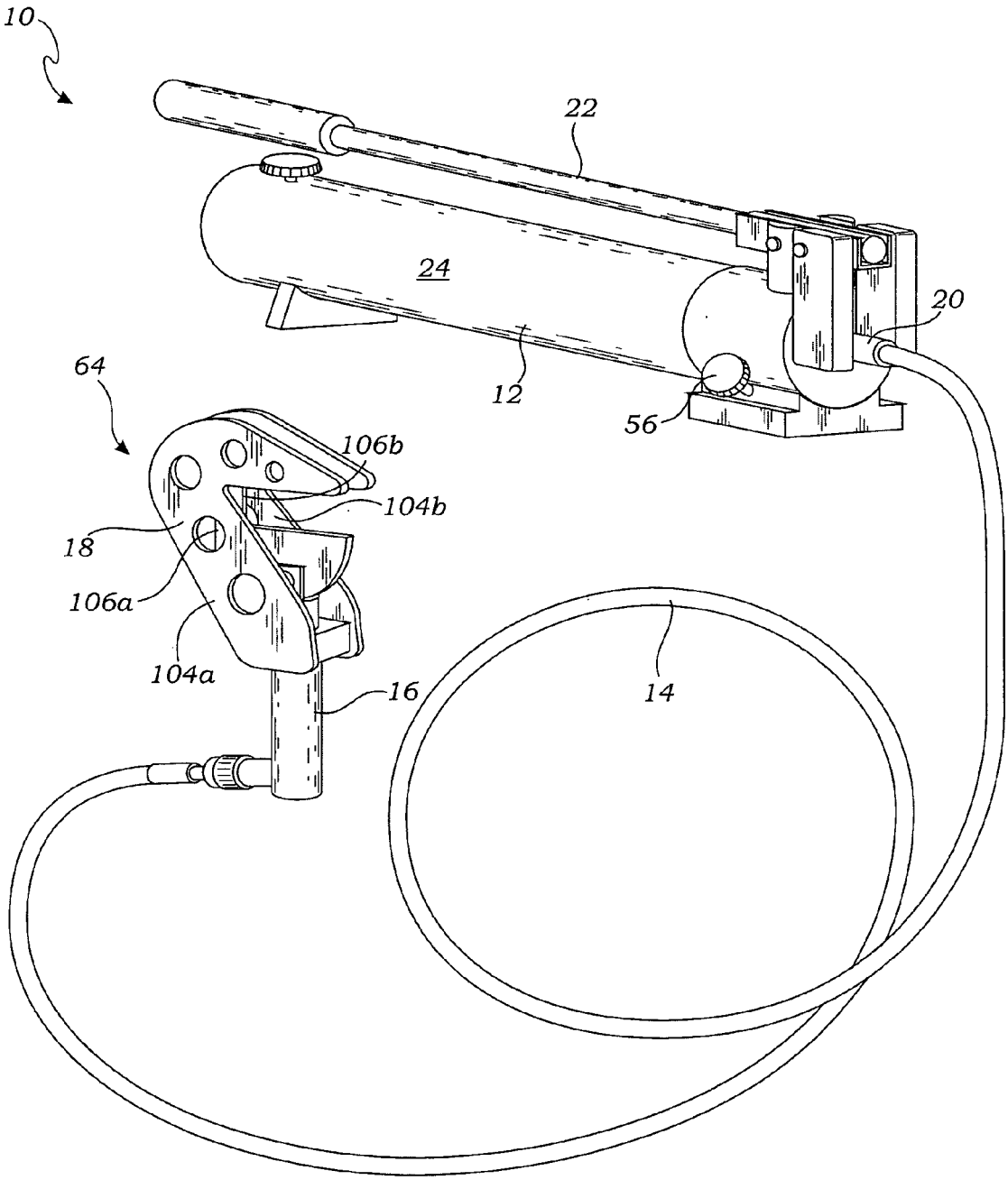
FIG. 1 is a perspective view of a jaw, a cylinder, an elongate flexible hose and a pump wherein the jaw and the cylinder are mechanically connected to each other and the cylinder, the elongate flexible hose and the pump are hydraulically connected to each other.

The figures referred to herein are for the purpose of illustrating the preferred embodiments of the present invention and not for the purpose of limiting the same. FIG. 1 illustrates a pipe shut off tool 10 comprising a pump 12, a hose 14, a cylinder 16 and a jaw 18. The pump 12 shown in FIG. 1 is a manual pump (e.g., hydraulic hand pump) but it is also contemplated within the scope of the present invention that the pump 12 may be an automatic pump. By way of example and not limitation, the various aspects of the present invention discussed herein will be discussed in relation to the hydraulic hand pump.

The pump 12 may be a single speed pump or a two speed pump such as those manufactured by ENERPAC. A single speed pump displaces an equal amount of hydraulic fluid through a hydraulic fluid output 20 during each stroke (defined below) of a handle 22 of the pump 12 despite an increase in pressure of the pump hydraulic fluid. A two speed pump displaces a variable amount of hydraulic fluid through the hydraulic fluid output 20 of the pump 12 based on the hydraulic fluid pressure. In particular, more hydraulic fluid is displaced through the hydraulic fluid output 20 when the hydraulic fluid pressure is below a threshold pressure compared to the amount of hydraulic fluid displaced through the hydraulic fluid output 20 when the hydraulic fluid pressure is above the threshold pressure.

The pump handle 22 may be traversable between a first position (see FIG. 1) and a second position. The handle 22 is in the first position when the handle 22 is parallel to a body 24 of the pump 12 and is in the second position when the handle 22 is oblique to the pump body 24. Hydraulic fluid contained within the pump body 24 may be made ready for pumping by traversing the handle 22 from the first position to the second position. As the handle 22 is subsequently traversed from the second position to the first position, hydraulic fluid may be displaced through the hydraulic fluid output 20 into the hose 14 and toward the cylinder 16. The traversal of the handle 22 from the first position to the second position and back to the first position is one stroke of the handle 22.

Figure 2A:
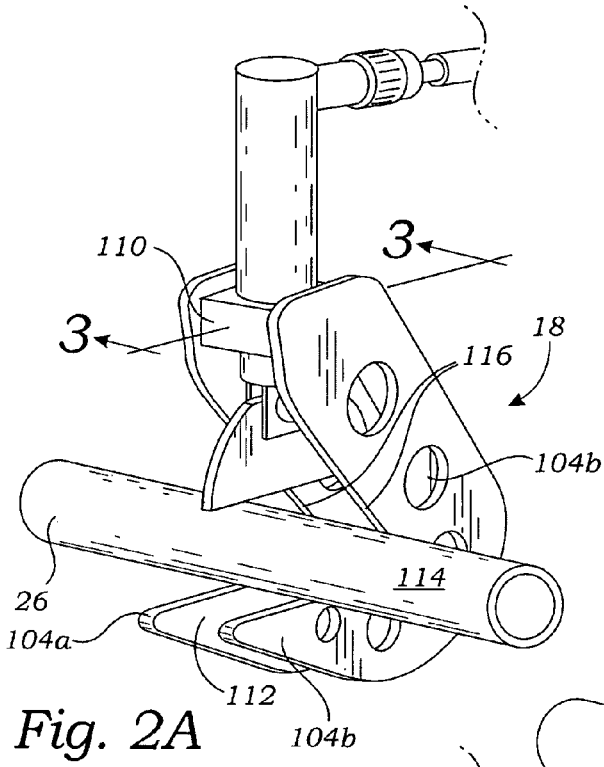
FIG. 2A is a perspective view of a pipe between crimping surfaces of the jaw prior to the crimping surfaces applying crimping pressure onto the pipe.
Figure 2B:
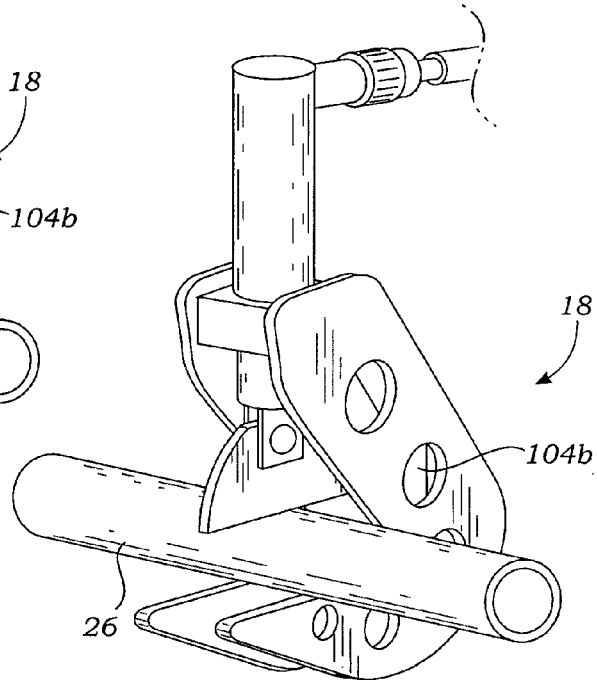
FIG. 2B is a perspective view of the pipe between crimping surfaces of the jaw when the crimping surfaces begin to apply crimping pressure onto the pipe.
Figure 2C:
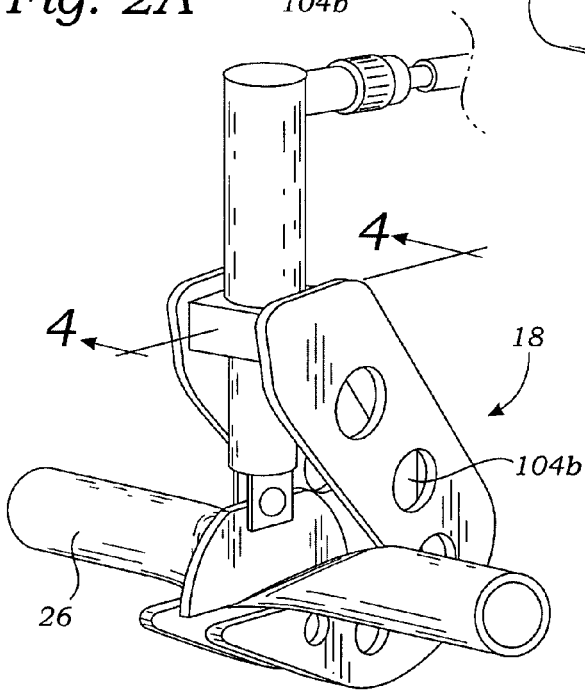
FIG. 2C is a perspective view of the pipe between crimping surfaces of the jaw when fluid flow through the pipe is shut off.

The pump 12 may be attached to the cylinder 16 and be in hydraulic communication therewith via the hose 14. The hose 14 may be a flexible elongate steel-reinforced rubber hose about six (6) feet long. The elongate hose 14 allows maintenance personnel to place the jaw 18 around a leaking pipe 26 (see FIG. 2A) and the pump 12 (see FIG. 1) away from the leaking pipe 26, near the tool operator. For example, if an underground pipe 26 was leaking, then the jaw 18 may be placed around the underground pipe 26 and the pump 12 may be placed on the ground such that the tool operator may conveniently operate the jaw 18 by stroking the pump handle 22 at ground level without having to bend down into a dirt hole, near the jaw 18 and pipe 26, to operate the jaw 18. FIGS. 2B and 2C illustrate operation of the jaw 18 as it crimps the pipe 26 to prevent fluid from flowing therethrough.

Figure 3:
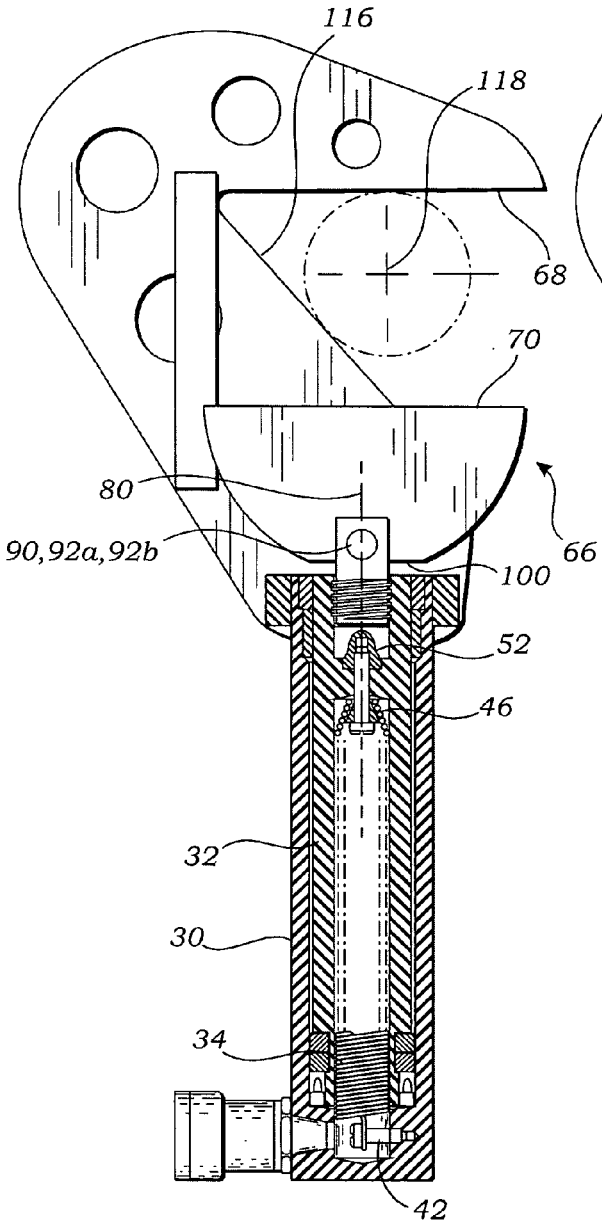
FIG. 3 is a cross sectional view of the jaw, the cylinder and the pipe of FIG. 2A.
Figure 4:
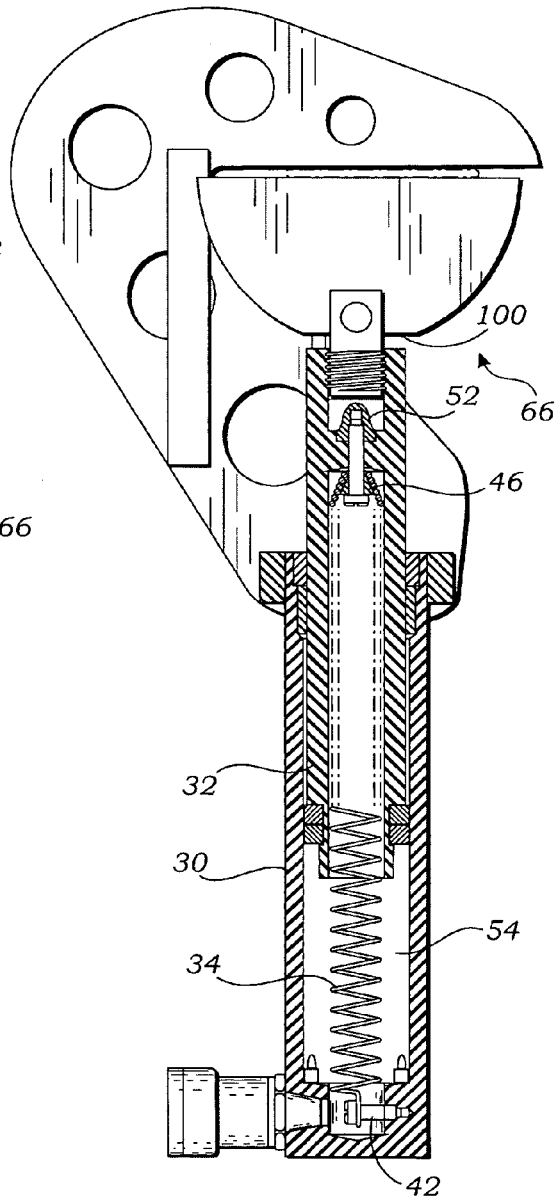
FIG. 4 is a cross sectional view of the jaw, the cylinder and the pipe of FIG. 2C.
Figure 5:
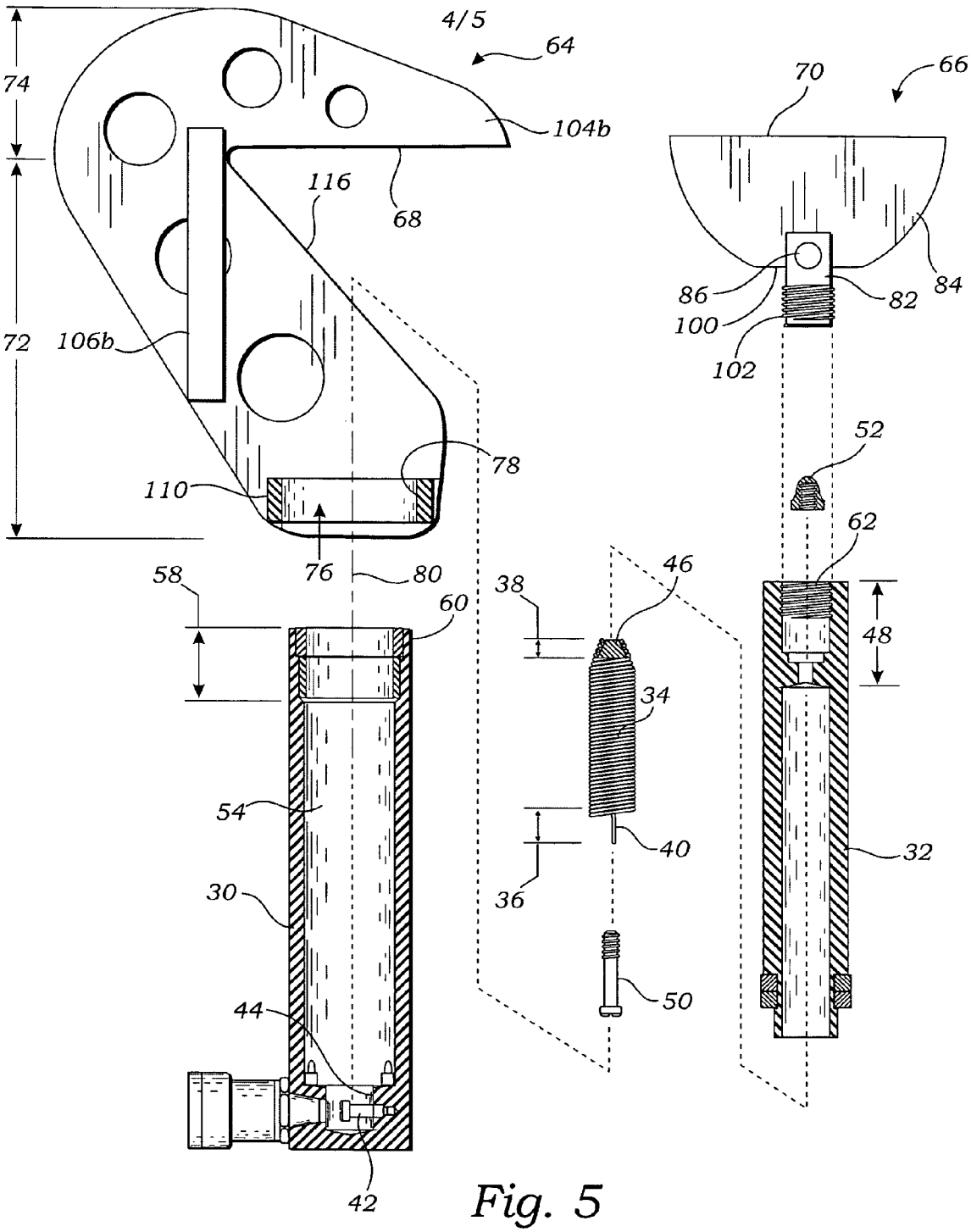
FIG. 5 is an exploded cross sectional view of the jaw and the cylinder of FIGS. 3 and 4.

Referring now to FIGS. 3–5, the cylinder 16 (see FIG. 1) may comprise a housing 30, a plunger 32 and a spring 34. The spring 34 may be an extension spring attached to the plunger 32 and the housing 30 to maintain the plunger 32 in a retracted position (see FIG. 3) and translate the plunger 32 from an extended position (see FIG. 4) to the retracted position. In particular, the spring 34 may define a cylindrical distal end 36 (see FIG. 5) and a conical distal end 38 (see FIG. 5). The cylindrical distal end 36 may further have a hook 40 (see FIG. 5) which may engage a mating screw 42 (see FIGS. 3–5) fixedly engaged to an inner surface 44 (see FIG. 5) of the cylinder 16. The conical distal end 38 may engage a bushing 46 (see FIGS. 3–5) connected to a distal portion 48 (see FIG. 5) of the plunger 32. A screw 50 (see FIG. 5) may be inserted into the bushing 46 (see FIGS. 4 and 5) and locked to the plunger distal portion 48 via an acorn nut 52 (see FIGS. 3–5).

The plunger 32 may be translated to the extended position by stroking the pump handle 22. During each stroke of the pump handle 22, hydraulic fluid may be pumped out of the pump 12 into the hose 14 and toward and into a cavity 54 (see FIGS. 4 and 5) of the cylinder 16. As more fluid is displaced into the cylinder cavity 54, the plunger 32 may be traversed to the extended position against a spring force of the spring 34 and a deformation force required to crimp the pipe 26. After the plunger 32 is traversed to the extended position and the leaking pipe 26 fixed, a release valve 56 (see FIG. 1) on the pump 12 may be opened to displace the hydraulic fluid pumped into the cylinder cavity 54 back into the pump 12 via the spring force. In other words, when the release valve 56 is closed, pumping action of the handle 22 displaces hydraulic fluid through the hydraulic fluid output 20 into the cylinder 16. Conversely, when the release valve 56 is opened, hydraulic fluid pumped into the cylinder 16 is displaced back into the pump body 24.

The cylinder 16 may be attached to the jaw 18. The housing 30 may have a housing distal portion 58 (see FIG. 5) and the plunger 32 may have the plunger distal portion 48. The housing distal portion 58 may be externally threaded 60 and the plunger distal portion 48 may be internally threaded 62. The jaw 18 may have a body 64 (see FIG. 5) attached to the housing 30 and a crimping member 66 may be attached to the plunger 32 (see FIGS. 3–5). The jaw body 64 and the crimping member 66 may define first and second surfaces 68, 70 (see FIGS. 3 and 5), respectively which may be drawn together with each stroke of the handle 22.

The jaw body 64 may have a support portion 72 and a crimping portion 74 (see FIG. 5). The support portion 72 may have an aperture 76. The aperture 76 may have a cylindrical configuration and be internally threaded 78. The aperture internal threads 78 may be threadably engagable to the housing distal portion external threads 60. The aperture 76 may also define a plunger axis 80 in that the plunger 32 is traversed between the retracted position (see FIG. 3) and the extended position (see FIG. 4) along the plunger axis 80.

Figure 6:
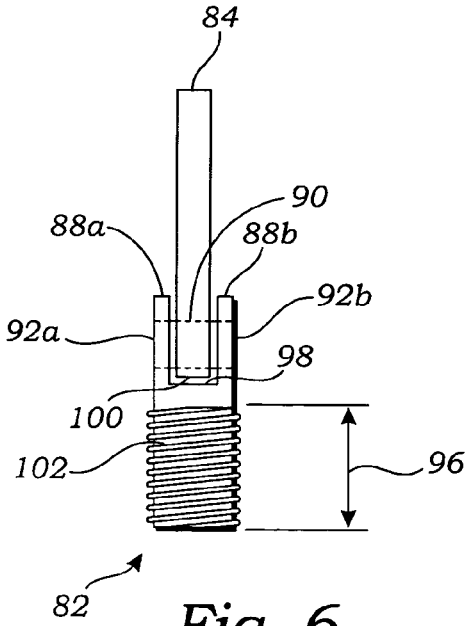
FIG. 6 is a side view of a saddle and a post.
Figure 7:
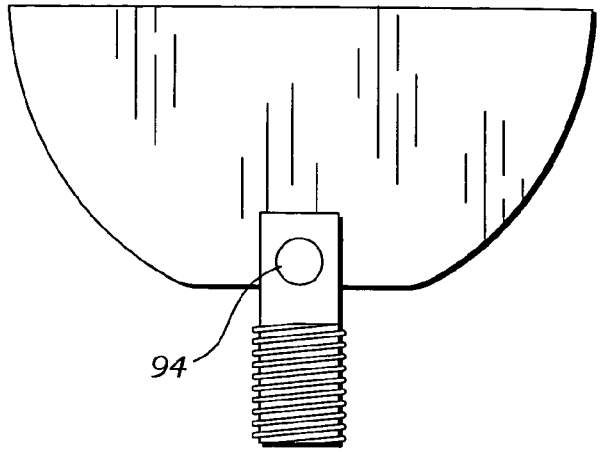
FIG. 7 is a front view of FIG. 6.

The crimping member 66 may comprise a post 82 and saddle 84 (see FIG. 5). The post 82 may be rotateably attached to the saddle 84 about a pivot point 86. The post 82 may have two tines 88*a, b* (see FIG. 6) and the saddle 84 may fit between the two tines 88*a*, 88*b*. The saddle 84 may have a circular aperture 90 which corresponds to apertures 92*a, b* formed on the tines 88*a, b*. The saddle aperture 90 and the tine apertures 92*a, b* may be aligned and a pin 94 (see FIG. 7) may plug the apertures 90, 92*a*, 92*b*. The pin 94 may have a friction fit with the tine apertures 92*a, b* and a loose fit with the saddle aperture 90 such that the saddle 84 may rotate about the pin 94. The tines 88*a, b* may be attached to a base 96 (see FIG. 6). The base 96 may define an inner surface 98 (see FIG. 6) which may contact a surface 100 (see FIGS. 3–6) of the saddle 84 to prevent the saddle 84 from excessively rotating about the pin 94. The post 82 may have external threads 102 formed on its base 94 which are threadably engagable to the plunger distal portion internal threads 62 (see FIG. 5). Accordingly, as the cylinder 16 is traversed between the retracted position (see FIG. 3) and the extended position (see FIG. 4), the crimping member 66 (see FIGS. 3 and 4) may be respectively traversed between a release position (see FIGS. 2A and 3) and a crimping position (see FIGS. 2C and 4). Further, as shown in FIG. 3, the apertures 90, 92*a*, 92*b* may be aligned with the plunger axis 80.

Figure 8:
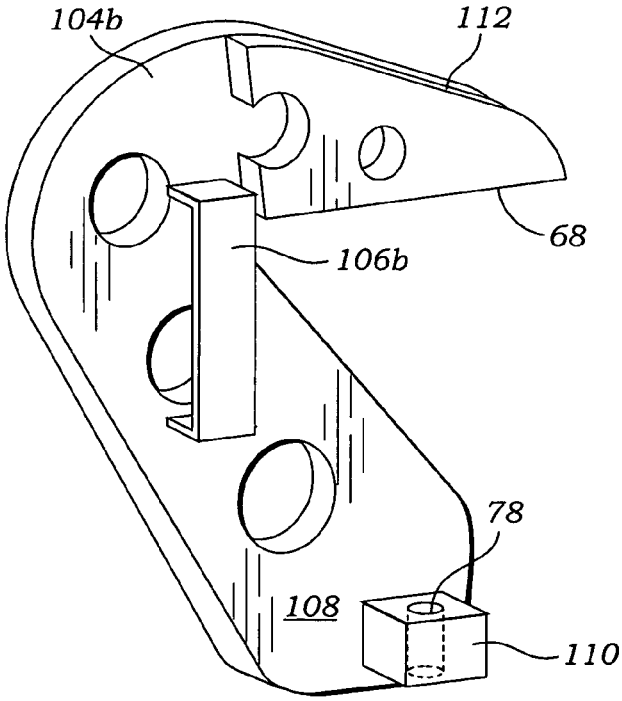
FIG. 8 is a perspective view of a right side wall of the jaw of FIG. 5.

The jaw body 64 (see FIGS. 1, 5 and 8) may include left and right sidewalls 104*a, b* placed adjacently parallel to each other. The left and right sidewalls 104*a, b* may be a mirror configuration with respect to each other. Left and right guides 106*a, b* (see FIGS. 1, 5, and 8) may also be attached to inner surfaces 108 (see FIG. 8) of the left and right sidewalls 104*a, b*. These guides 106*a, b* abut the saddle 84 (see FIGS. 3 and 4) and maintain the saddle 84 in a perpendicular relationship with the pipe 26 inserted into the jaw 18 along the entire traversal distance (i.e., between release position and crimping position; see FIGS. 2A–2C) of the saddle 84. In other words, the guides 104*a, b* prevent the saddle 84 from rotating about the plunger axis 80.

The left and right sidewalls 104*a, b* may have a support filler 110 (see 2A, 5 and 8) interposed therebetween. The support filler 110 may define the internally threaded apertures 78 (see FIGS. 5 and 8) threadably engageable to the housing distal portion external threads 60. The left and right sidewalls 104*a, b* may also have a crimping filler 112 (see FIGS. 2A and 8) interposed therebetween. The crimping filler 112, left side wall 104*a* and right side wall 104*b* may define the first crimping surface 68. The first crimping surface 68 may be substantially flat and/or pitted to receive an exterior surface 114 of the pipe 26. Also, the second crimping surface 70 may be substantially flat and/or pitted to receive the pipe exterior surface 68. The first crimping surface 68 may also be perpendicular to the plunger axis 80. Also, the first and second crimping surfaces 68, 70 may be parallel to each other.

The support portion 72 (see FIG. 5) may also define an oblique surface 116 (see FIG. 5) with respect to the first and second crimping surfaces 68, 70. The oblique surface 116 may be pitted or flat. The oblique surface 116 and the first crimping surface 68 may have a "V" shaped configuration (see FIG. 5), and the pipe 26 may be inserted between the first and second crimping surfaces 68, 70 (see FIG. 2A) until the pipe exterior surface 114 physically contacts the oblique surface 116. The oblique surface 116 may maintain a status quo relationship between a central axis 118 of the pipe 26 and the plunger axis 80. For example, if the plunger axis 80 is under-center, as shown in FIG. 3, with respect to the central axis 118 (see FIG. 3) of the pipe 26 inserted between the first and second crimping surfaces 68, 70, then the oblique surface 116 maintains the under-center relationship despite changes in a diameter of the inserted pipe 26. If the pipe diameter is too small then the plunger axis 80 may become over-center with respect to the pipe central axis 118 but for large pipe diameters, the oblique surface 116 urges the plunger axis 80 into the under-center relationship with the pipe central axis 118. Alternatively, if the plunger axis 80 is substantially aligned to the pipe central axis 118, then the oblique surface 116 maintains the substantial alignment between the pipe central axis 80 and the plunger axis 118 except for excessively large or small pipe diameters. It is also contemplated within the scope of the present invention that if the plunger axis 80 is over-center with respect to the pipe central axis 118 (preventing the pipe 26 from slipping out of the jaw 18 as the crimping member 66 is traversed from the release position to the crimping position), then the oblique surface 116 prevents the pipe central axis 80 from becoming too over-center such that excessive torque is not applied to the plunger 32.

To use the tool 10, the user may open the pump release valve 56 to ensure that the cylinder 16 is in the retracted position. The pipe 26 may be inserted into the jaw 18 between the first and second crimping surfaces 68, 70 (see FIG. 2A). The pump handle 22 may be repetitively stroked to pump hydraulic fluid from the pump body 24 into the cylinder 16. During this initial stage before the crimping member 66 applies any appreciable pressure or force on the pipe 26, the pump 12 may displace hydraulic fluid out through the hydraulic fluid output 20 at a high rate (i.e., first speed): the first and second crimping surfaces 68, 70 closes onto the pipe 26 at a high rate. As the handle 22 is further stroked, the crimping member 66 may physically contact the pipe 26 and increase pressure of the pump hydraulic fluid. Once the pressure of the hydraulic fluid increases above a threshold pressure (e.g., about 200 psi) which means that an appreciable pressure is applied on the pipe 26 by the crimping member 66, the pump 12 transitions to the second speed. The second speed displaces hydraulic fluid through the hydraulic fluid output 20 at a rate less than the first speed. However, the hydraulic fluid may reach pressures of up to about 10,000 psi, and as a result, more pressure may be applied to the pipe 26 during the second speed compared to the pressure applyable to the pipe 26 during the first speed by the crimping member 66. This allows the user to quickly traverse the crimping member 66 to the crimping position from the release position until the crimping member 66 contacts the pipe 26. Once the crimping member 66 contacts the pipe 26, more pressure is required to squeeze the pipe 26 shut. As such, the pump 12 may automatically or manually transition to the second speed—higher pressure (e.g., about 10,000 psi hydraulic fluid pressure) but slower rate of fluid transfer. In tests, a two inch copper pipe was crimped shut in less than ten (10) seconds.

This description of the various embodiments of the present invention is presented to illustrate the preferred embodiments of the present invention, and other inventive concepts may be otherwise variously embodied and employed. The appended claims are intended to be construed to include such variations except insofar as limited by the prior art.

What is claimed is:

1. A jaw engageable to a housing and a plunger of a cylinder for crimping a pipe, the plunger being traversable between an extended position and a retracted position, the jaw comprising:

a. a body having a support portion and a crimping portion, the support portion having an aperture attachable to the housing and defining an oblique surface, the crimping portion defining a first crimping surface, the first crimping surface and the oblique surface having a V-shaped configuration for receiving the pipe therebetween;

b. a crimping member defining a second crimping surface parallel to the first crimping surface and being attachable to the plunger, the crimping member being traversable between a crimping position and a release position when the plunger is traversed between the extended position and the retracted position, respectively;

c. wherein the aperture defines a plunger axis along which the plunger and crimping member traverses and the plunger axis is over-center with respect to a central axis of the pipe received between the first crimping surface and the oblique surface to retain the pipe within the jaw as the pipe is crimped.

2. A jaw engageable to a housing and a plunger of a cylinder for crimping a pipe, the plunger being traversable between an extended position and a retracted position, the jaw comprising:

a. a body having a support portion and a crimping portion, the support portion having an aperture attachable to the housing and defining an oblique surface, the crimping portion defining a first crimping surface, the first crimping surface and the oblique surface having a V-shaped configuration for receiving the pipe therebetween;

b. a crimping member defining a second crimping surface parallel to the first crimping surface and being attachable to the plunger, the crimping member being traversable between a crimping position and a release position when the plunger is traversed between the extended position and the retracted position, respectively;

c. wherein the first and second crimping surfaces are pitted.

3. The jaw of claim 1 wherein the body includes:

a. left and right side walls;

b. a crimping filler being interposed between the left and right side walls, the left side wall, right side wall and the crimping filler defining the first crimping surface; and c. a support filler being interposed between the left and right side walls and defining the aperture.

4. The jaw of claim 3 wherein the support filler aperture is internally threaded for threadable engagement with the cylinder housing.

5. The jaw of claim 1 wherein the crimping member comprises:

a. a post connectable to the plunger; and b. a saddle being pivotably attached to the post and defining the second crimping surface.

6. The jaw of claim 5 wherein the post is externally threaded for threadable engagement to the cylinder plunger.

7. A pipe shutoff tool for stopping fluid flow through a pipe, the tool comprising:

a. a pump having a first speed and a second speed;

b. an elongate flexible hose defining a first distal end and a second distal end, the first distal end attached to the pump;

b. a cylinder attached to the hose second distal end, the cylinder comprising a plunger and a housing, the plunger being traversable between a retracted position and an extended position; and c. a jaw comprising a body attachable to the housing and a crimping member attachable to the plunger, the crimping member being traversable between a release position and a crimping position when the plunger is traversed between the retracted position and the extended position, respectively, the crimping member being traversed from the release position to the crimping position at a faster rate when the pump is operating at the first speed compared to the second speed to allow the crimping member to be quickly traversed from the release position to the crimping position when the pump is operating at the first speed then to permit the crimping member to apply a crimping pressure to the pipe when the pump is operated at the second speed.

8. The tool of claim 7 wherein the plunger is normally biased to the retracted position.

9. The tool of claim 8 wherein the plunger is normally biased to the retracted position with a spring.

10. The tool of claim 7 wherein the hose is about six feet long.

11. The tool of claim 7 wherein the pump speed is transitioned from the first speed to the second speed without any user intervention.

12. The tool of claim 7 wherein the pump transitions from the first speed to the second speed when a pressure of fluid within the pump exceeds a threshold pressure and the crimping member applies pressure to the pipe.

13. The tool of claim 12 wherein the pressure applied to the pipe by the crimping member when the fluid within the pump exceeds the threshold pressure is sufficient to hold the jaw onto the pipe.

14. A method of preventing fluid flow through a pipe, the method comprising the steps of:

a. positioning first and second crimping surfaces of a jaw adjacent to the pipe;

b. stabilizing a hand pump on a surface; and c. stroking a handle of the hand pump stabilized on the surface until fluid flow through the pipe is stopped, the stroking step comprising the steps of:

i. displacing hydraulic fluid from the hand pump at a first speed until the first and second crimping surfaces applies pressure to the pipe and pressure of the hydraulic fluid is greater than a threshold pressure;

ii. displacing hydraulic fluid from the hand pump at a second speed which is slower than the first speed until fluid flow through the pipe is stopped.

* * * * *